US005638580A

United States Patent [19]

Kim

[11] Patent Number: 5,638,580

[45] Date of Patent: Jun. 17, 1997

[54] METHOD OF SPINNING ALL-WOOL YARN ON COTTON SYSTEM

[75] Inventor: Ki Whan Kim, Seoul, Rep. of Korea

[73] Assignee: Hanol Spinning Co., Ltd., Rep. of Korea

[21] Appl. No.: 584,742

[22] Filed: Jan. 11, 1996

Related U.S. Application Data

[63] Continuation-in-part of Ser. No. 353,451, Dec. 9, 1994, abandoned.

[51] Int. Cl.[6] ..... D01H 5/86

[52] U.S. Cl. ..... 19/244; 19/236; 19/261

[58] Field of Search ..... 19/236, 244, 253, 19/261

[56] References Cited

U.S. PATENT DOCUMENTS

| | | | |
|---|---|---|---|
| 207,626 | 9/1878 | Sargent | 19/244 X |
| 2,037,836 | 4/1936 | Truslow | 19/244 X |
| 3,105,998 | 10/1963 | Raboisson | 19/236 X |
| 3,609,836 | 10/1971 | Morrison et al. | 19/244 X |

*Primary Examiner*—John J. Calvert
*Attorney, Agent, or Firm*—Leonard Bloom

[57] ABSTRACT

Worsted grade all-wool of fair quality can be spun on cotton spinning system. Wool top is processed at first passage of cotton drawing frame instead of gill, with cutting and drafting with suitable distance between front and third rollers. Second and back top rollers are removed so that wool sliver which is more uniform and which has a shorter staple length distribution can be processed with roller drafting only. The second to last passage is processed with the same distance between the front and third roller as the first passage and also has the second and back top rollers removed. The sliver is fed through three (3) pairs of the rollers and one pair of aprons of a cotton roving frame, the draft is the same distance as the first passage of drawing process between front and back rollers and uses an engraved middle top roller. Yarn is spun on a cotton ring frame by drafting the fed roving through three pairs of rollers and one pair of aprons. The same draft distance as the first passage of the drawing frame between the front and back rollers is set on the spinning frame. An engraved middle top roller is again used. Worsted grade all wool yarn can be produced utilizing commercially running cotton system with minimum modification.

4 Claims, 6 Drawing Sheets

(a)

(b)

(c)

METHOD OF SPINNING ALL-WOOL YARN ON COTTON SYSTEM

CROSS REFERENCE TO RELATED APPLICATIONS

This application is a continuation-in-part of application Ser. No. 08/353,451 filed Dec. 9, 1994, abandoned, for "METHOD OF SPINNING ALL-WOOL YARN ON COTTON SYSTEM", the disclosure of which is incorporated herein in its entirety.

BACKGROUND OF THE INVENTION

This invention relates to a method of spinning all-wool yarn on an improved cotton system, in which the all-wool yarn with the same quality of usual worsted yarn can be spun on the improved cotton system.

All-wool yarn must be spun on worsted system, or on woolen system, however, it has not been successfully spun, on cotton system. On a worsted system, procedures and devices therefor, are different from those of the cotton system. Wool staple length is long and distribution of the length usually is extremely uneven compared to those of cotton. Wool top is virtually impossible to draft with roller drafting, mechanism. Good uniformity of product requires faller bar incorporation into the process.

If a distance between drafting rollers could be set in accordance with the longest fiber length, shorter fibers would be floated, when being drafted, while longer fibers that exceed the distance between the rollers, would be broken or cut. In the former case, fallers must be applied on gill frame to control these floating fibers.

Recently, cotton-wool blended yarns are spun with squared wool fiber, but all-wool yarns like worsted yarns cannot be spun by means of the conventional cotton system until now. With worsted yarns produced by the conventional worsted yarn system, long fibers of more than 120 mm length of wool top occupies only about 10% of the total. Therefore, for the purpose of uniform drafting, gilling should be used. However, in general, worsted spinning system is considered as of higher cost and lower in productivity, which results in much higher spinning costs in worsted system than in cotton system.

In this connection, the purpose of the present invention is to provide spun-worsted-like wool yarns on improved cotton system with considerable lower cost, as well as higher productivity and good quality.

The present invention starts from two fundamental findings:

1. About 10% of longer fibers of wool top require extra-long distance of drafting rollers, that is, about 10% of wool fiber is abnormally long, 2. These abnormally long fibers can be cut on cotton drawing frame with suitable distance between two pairs of the drafting rollers. Staple length distribution of this cut wool top becomes shorter and becomes more uniform, enabling the cut top to be suitable for roller drafting without any fallers. This cut fleece of wool can proceed to later passages of drawing, roving, ring spinning on the conventional cotton system.

In the conventional prior art, Raboisson's drafting mechanism which is disclosed in U.S. Pat. No. 3,105,998, can be applied on roving frame and ring frame to draft wool fibers which are much longer than those of cotton.

However, Raboisson's drafting mechanism cannot work for all-wool yarn, because:

1. The distance between two pairs of rollers must always be wider than the longest fiber length. The majority of wool has the longest fiber longer than the maximum available distance between front and back rollers of drawing, roving and ring frame commercially running cotton system, so that it is substantially impossible for all wool to be processed with the Raboisson's mechanism on the line of the cotton system.

2. In case of wool comprised with comparatively shorter staple length, the variation of the staple length is too great, and the distance between the rollers is too wide to draft this wool. The floating fibers disturb good drafting. As a result, quite uneven sliver, roving and yarn are produced which are of no commercial value at all.

BRIEF SUMMARY OF THE INVENTION

According to the present invention, worsted grade all-wool yarn of fair quality can be spun on a cotton spinning system. Wool top is processed at first passage of cotton drawing frame instead of the gill, and is cut and drafted with a suitable distance between the front and third rollers while removing the second and back top rollers. This permits drawing wool sliver having uniform and shorter staple length distribution which can be processed with roller drafting only. The second to last passages are proceeded with same distance between the front and third rollers, removing the second and back top rollers. The sliver is fed through three (3) pairs of the rollers and one pair of aprons of cotton roving frame, drafting with the same distance as in the first passage of the drawing process between the front and back rollers using engraved middle top rollers. All wool-yarn is spun on cotton ring frame, drafting the fed roving through three pairs of the rollers and one pair of aprons with the same distance as in the first passage of the drawing frame between the front and back rollers using engraved middle top rollers. Worsted all wool can be obtained utilizing commercially running cotton system with minimum modification.

These and other objects of the present invention will become apparent from a reading of the following specification taken in conjunction with the enclosed drawings.

DESCRIPTION

Figure 1:
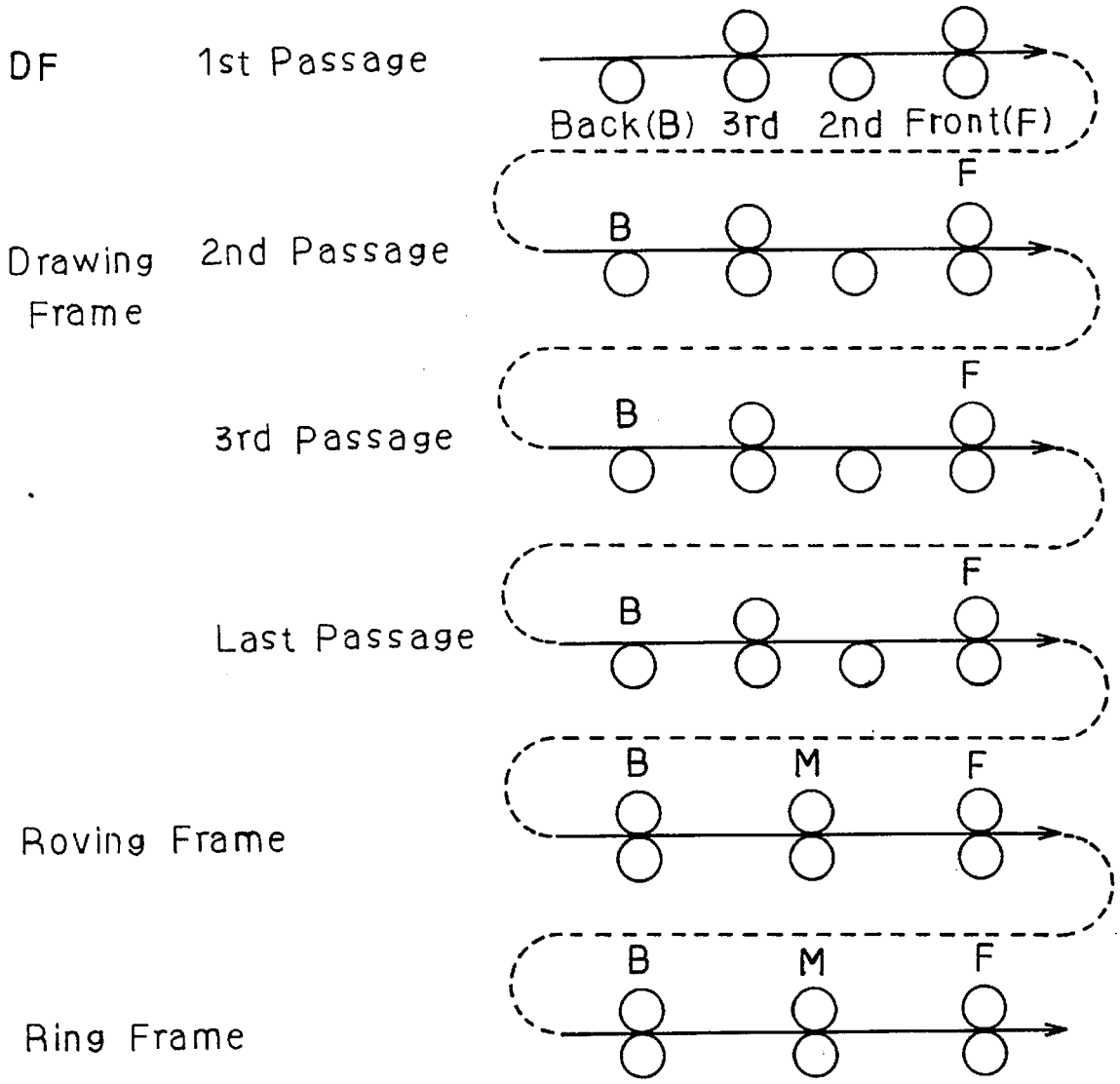
FIG. 1 shows arrangement of drawing frame (DF) and roving frame (RF) in the present invention.

Drafting mechanism of the present invention may be compared to the faller draft in FIG. 1. Recombed bed top is processed on gill frame with faller drafting apparatus and gilling as shown. The processing is usually repeated four (4) to six (6) times to get the top of good quality. In the present invention, the recombed bed top is fed on the drawing frame of the cotton system on which four pairs of bottom and top rollers are mounted.

In the present invention, it was found that the wool fibers longer than 120 mm, in general, frequently are broken on the drawing frame of the cotton system with a suitable gauge set when drafting of wool top in which the longest fiber length would be set about 160 mm.

Wool fibers are usually cut in a gauge setting of 45–50 mm length in the cotton system, however, in the event the wool fibers are over 120 mm in length, being longer than the gauge setting, then the fibers may easily be cut.

Figure 8:
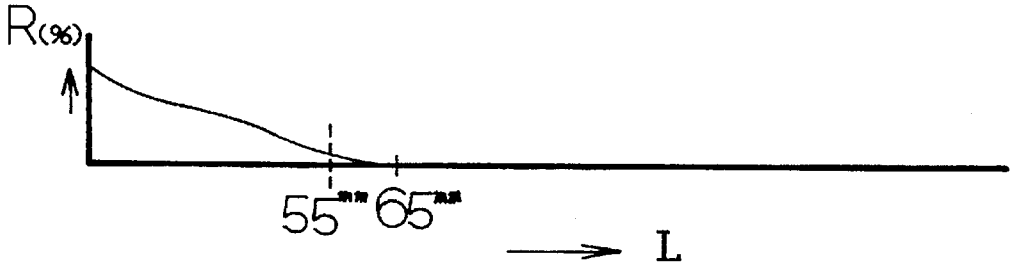
FIG. 8 shows examples of fiber length of wool fibers, which are set in various types in the present invention.
Figure 8:
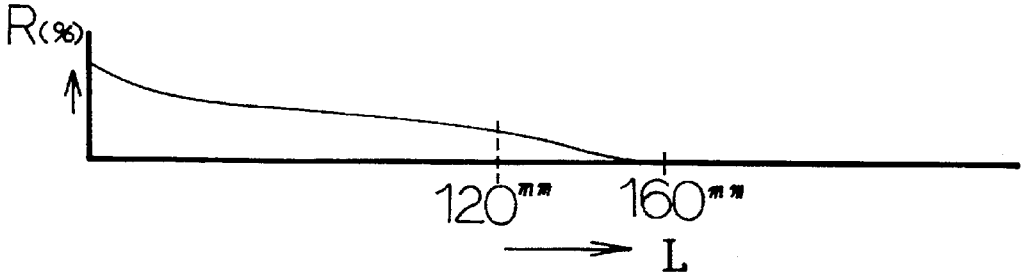
Figure 8:
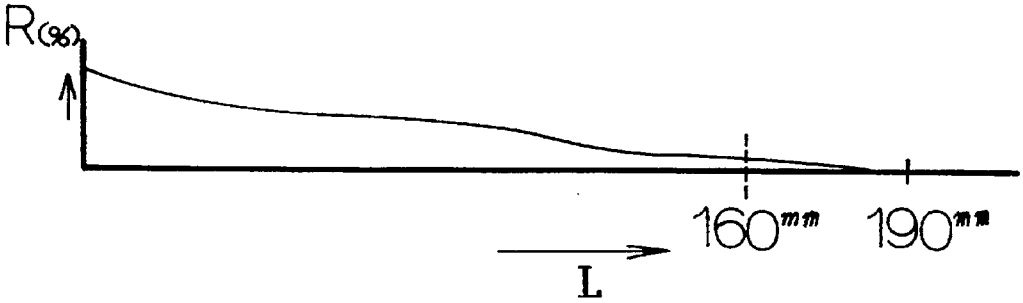

Wool type may be classified as A, B, C as shown in FIG. 8, in general. In case of A, the gauge setting length is 55 mm (longest fiber: 65 mm), in case of B, the gauge is set to 120 mm (longest fiber: 160 mm), and in the case of C, the gauge is set to 160 mm (longest fiber: 190 mm). In case of other wool fibers having length between A and C, the gauge setting length is controlled freely within the aforesaid limits.

Figure 2:
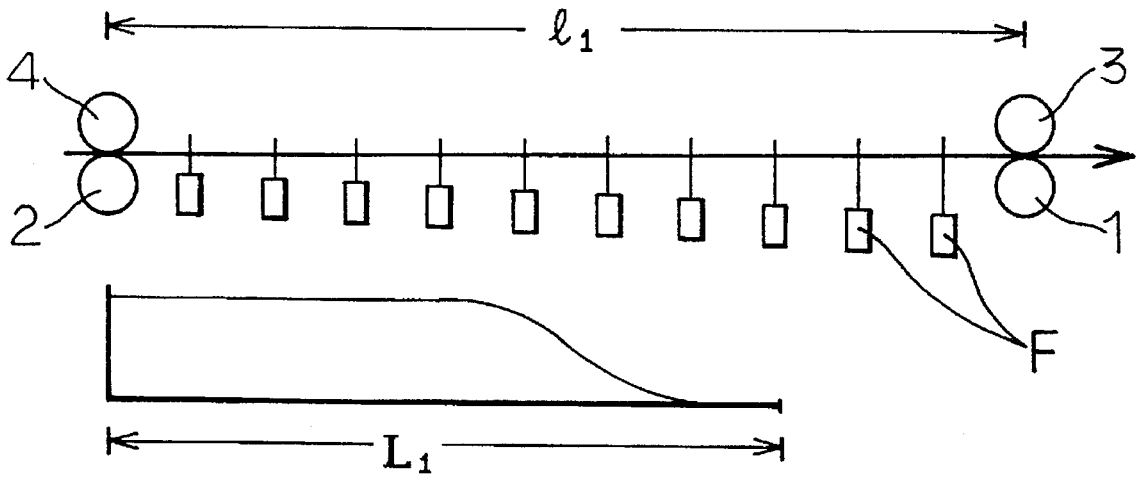
FIG. 2 shows faller drafting mechanism for explanation of the present invention. In this drawing, the reference numerals are: front bottom roller 1, back bottom roller 2, front top roller 3, back top roller 4, distance between front and back roller l1, faller F, and L1 shows the longest staple length (l1>L1).

In FIG. 2, wool top with the longest fiber L1 is processed with the distance l1 between the two pairs of rollers, and the fallers on gill.

Figure 3:
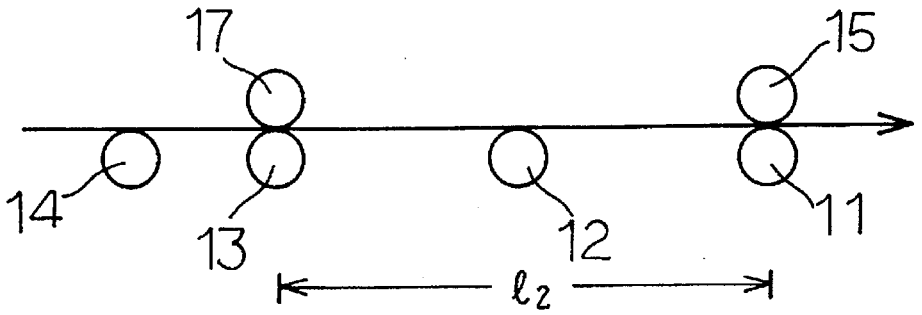
FIG. 3 shows cutting and drafting mechanism of the present invention at the first passage of drawing. In this drawing, the reference numerals are: front bottom roller 11, second bottom roller 12, third bottom roller 13, back bottom roller 14, front top roller 15, third top roller 17, and distance between front and third roller l2 (l2<L1).
Figure 4:
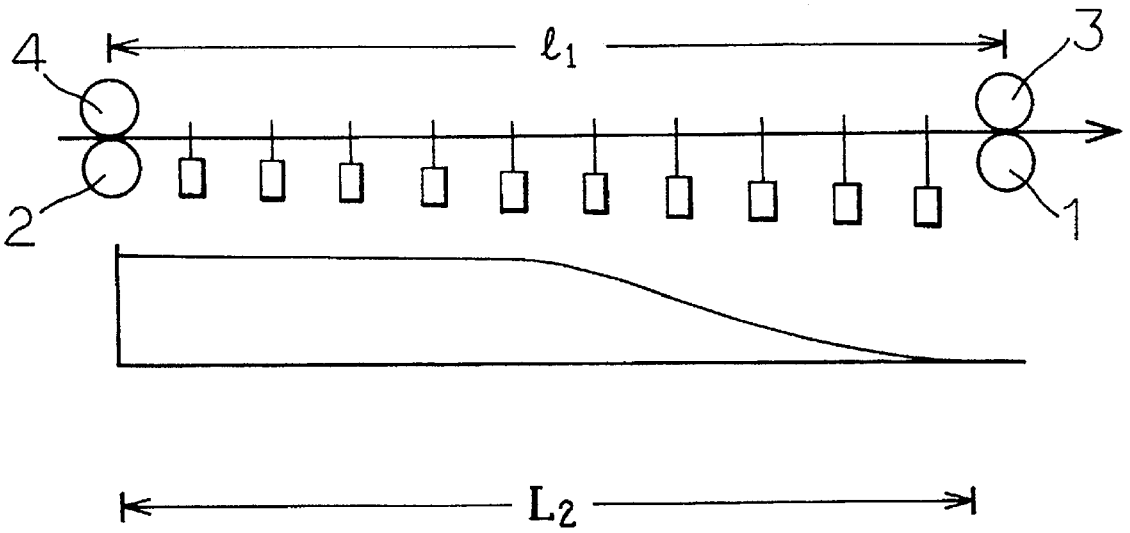
FIG. 4 shows faller drafting mechanism for wool fiber of longer staple length. Reference numerals are same as in FIG. 2. In this figure, reference numeral L2 indicates longest staple length of the longer wool fiber (l1>L2).
Figure 5:
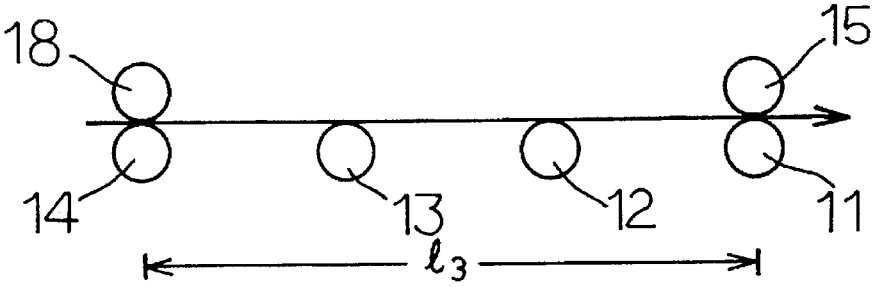
FIG. 5 shows cutting and drafting mechanism of the present invention at the first passage of drawing for wool fiber of longer staple length. Reference numerals 11 to 15 are same as in FIG. 3 respectively. Reference numeral 18 is back top roller, reference numeral l3 is distance between front and back roller (l3<L2).

In FIG. 3, the same wool top is cut and drafted with distance l2 between the front and the third roller, while the second and back top rollers are removed. Wool top of a length, for example, l2=172 mm, was successfully processed with distance of l1=120 mm. As the result, this wool top became shorter and more uniform, suitable for roller drafting in a later process. l2 is determined by trial and error method, until the shortest length for cutting is found. If l2 is too short, the wool fleece would not be cut, and drafting becomes impossible. If l2 is too long, the uniformity of cut wool staple may not be of good quality. This means that wool of longer staple length requires a greater distance of l2. In FIG. 3, longer top is processed with the same distance of l1 as on the gill frame, but instead, on the cotton drawing frame. A longer distance (l3) than l2 is provided between the front and back rollers, removing the second and third top rollers as shown in FIG. 5.

For clarifying the feature of the present invention, we now further explain it in comparison with the U.S. Pat. No. 3,105,998 of Raboisson. His draft mechanism shows that:

1. the wool staples are not cut and drafted only, and 2. the top rollers are not recessed or cut but removed, which are quite different from those of the present invention.

The second passage of drawing is processed, drafting with the same distance l2 or l3. The third, fourth and fifth, are processed as the first passage. This cut and draft technique could be applied to the three (3) over three (3) roller system, or the five 5) over four (4) roller system, or to other combinations of rollers with suitable distance l2 and with removal of the top rollers as well.

Figure 6:
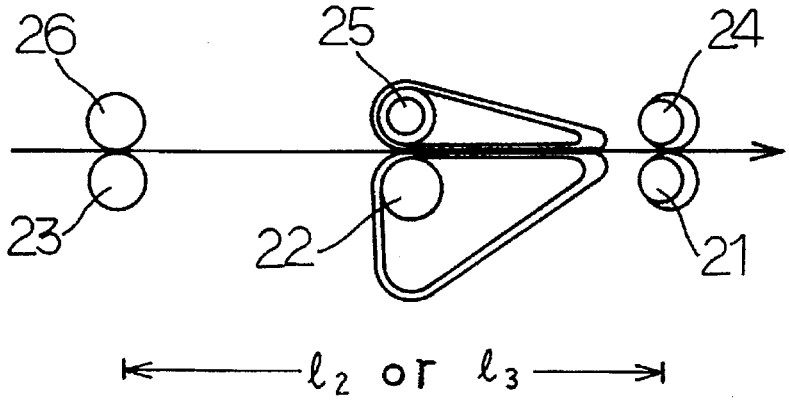
FIG. 6 shows drafting mechanism of the invention at roving frame and spinning frame. The reference numerals are: front bottom roller 21, middle bottom roller 22, back bottom roller 23, front top roller 24, middle top roller with engraved boss 25, back top roller 26, and reference numeral l2 indicates distance between front and back roller which is same length as in FIG. 3. Reference numeral l3 indicates distance between front and back roller for wool fiber of longer staple length.
Figure 7:
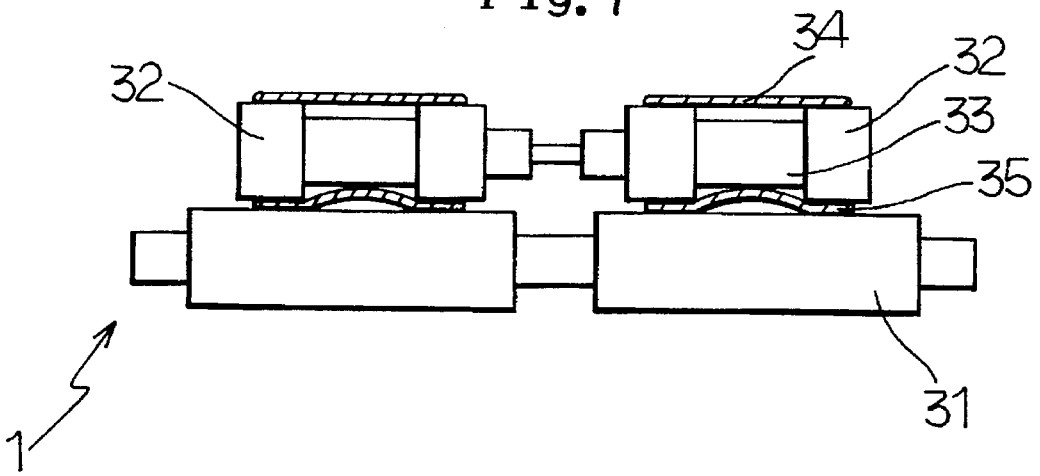
FIG. 7 shows recessed area of cut boss and state of action of wool fleece against apron. In this figure, the reference numerals are: bottom roller 31, non-cut area of top roller boss 32, cut area of top roller boss 33, straight apron 34, bent apron 35 by wool fleece which is being passed between bottom and top apron.

On roving frame, more uniform and shorter wool sliver is fed through three pairs of top and bottom rollers with upper and lower aprons. The middle top roller is cut as shown in FIG. 6 and FIG. 7, which is found in the prior art as in the above Raboisson's drafting mechanism. The distance between the front and back rollers, is the same as in the drawing frame, that is l2. Four pairs of rollers, are the same as in the drawing frame, that is l2. Four pairs of rollers with a pair of aprons could be applied, accordingly.

On the ring frame, the wool yarn is spun, while being drafted with three pairs of rollers and a pair of aprons, as shown in FIG. 6 and FIG. 7. Yarn cleaning on winding apparatus, is done by known methods resulting in all-wool yarn of fair quality.

Hereunder, the method of spinning all-wool yarn in the present invention as the improved cotton system, is explained in detail.

EXAMPLE 1

In the present invention, for doing effective spinning of wool yarn, the distance between the front and back roller pairs is set to 55–160 mm on the drawing frame (DF). This gauge is determined in accordance with the length of wool fibers. On the roving frame (RF), this gauge between the front and back roller pairs, is set to 55–160 mm, the same as in the drawing frame (DF).

Figure 10:
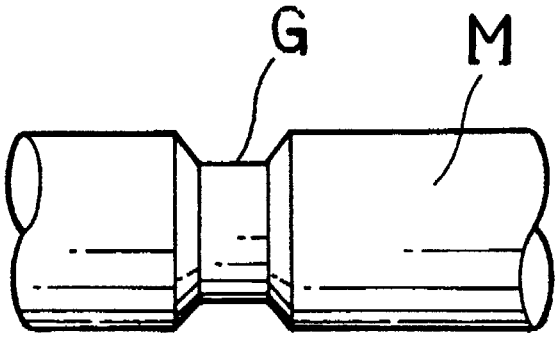
FIG. 10 shows groove shaped portion G of the middle roller (M).

Besides this distance control, control of the roller apron in its fore tip part is available for guiding and arranging fibers (FIG. 1). To apply the apron control on the roving and ring frame when drafting wool top, a groove of rectangular or flat or round shape, with a flat bottom vertical to the roller axis, is cut away on the middle roller (M), as shown in FIG. 10. Width and depth of the groove (G in FIG. 10) depends upon the type of the wool fibers.

For longest wool fiber such as wool top of about 160 mm length in the wool staple of the present invention, the distance between the front and back roller is set as 120 mm, FIG. 8(*b*) (type B). This produces effective extension and doubling wool staple mean length, which brings about uniform disposition state between the front roller (F in FIG. 1) and the back roller (B in FIG. 1) in the draw frame (DF). Applying draft on wool sliver, the staples of which the length is longer than 120 mm, was broken into a shorter length of fiber. Consequently, the fiber length distribution of the drafted sliver becomes more uniform and the maximum length of the fiber becomes 120 mm. This sliver having uniform length was drafted and controlled successfully with two pairs of rollers instead of the gill.

Figure 9:
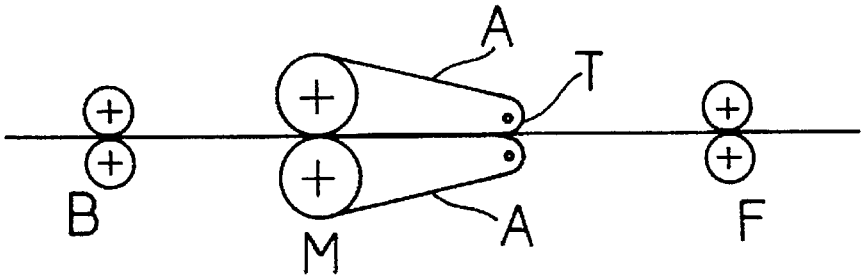
FIG. 9 shows apron which is applied on the roving frame, consisting of rubber and other elastic materials, and rotated around the rollers.

On the roving frame (RF in FIG. 1), the function of drafting was same as that of the drawing frame (DF). Apron (A in FIG. 9) was applied on the roving frame (RF). The apron usually consists of rubber and the like such as elastic materials, and could be rotated around the rollers as shown in FIG. 9. In the two fore tip parts (T) on the line and which is rotated around the roller like belt, the apron (A) guided fibers for safe forwarding direction. Usually, the apron (A) is applied on middle pairs of the rollers. Middle rollers (M) were not removed because of the apron control, these rollers disturbed the flow of the long staple of wool fiber.

In this regard, it was prepared to be passed under a tunnel at the surface of upper roller of the middle roller (M). As stated above, a groove was engraved as shown G in FIG. 10, 2 mm in depth (usually about 1 to 3 mm), which is vertically shaped to the axis of each roller. The drafting method on the ring frame, was also same as on the roving frame.

EXAMPLE 2

1/48 of worsted wool-yarn was spun on the improved cotton system of the present invention. Wool top of 21.5u× 65HM, that is, mean fiber length of 65 mm, and longest length of 160 mm, was drawn on the cotton draw frame with a roller gauge (distance) of 120 mm. Total passage was processed with eight (8) doubling and drafting ratio, was eight 8). Roving was produced on the roving frame with a roller gauge of 120 mm, and grooved middle rollers for apron control. Draft ratio was 8.2. On the ring frame, the gauge setting was 120 mm, the spindle speed was 8,000 r.p.m., and TPM was 974. The u % of the produced yarn 1.48 was 16.5%, which was the average rating. The longest staple length of the fed wool was 172 mm and mean length was 77.0 mm. The longest staple in processed sliver from the last drawing frame, was 120 mm, and the mean length of the same fiber was 74.5 mm.

EXAMPLE 3

1/32 of worsted wool yarn was spun. Wool top of 24u× 60HM, that is, mean fiber length of 50 mm, and longest length of 140 mm, was drawn on the cotton draw frame with a gauge (distance) setting of 120 mm. Total passage was four (4) with eight 8) doubling of each passage and drafting ratio of eight (8). The gauge setting was 100 mm, on the roving frame and the ring frame was 8,500 r.p.m. The twist was 469 TPM. u % of the produced yarn 1.32 was 15.1%. The longest staple length of raw wool top was 144 mm, the mean length was 57.8 mm, the longest staple length of fiber from the last passage of the draw frame was 100 mm, and the mean length of it was 55.0 mm.

The above yarns were doubled and twisted to use for knitting, the quality of the product twisted to use for knitting was fine. Finer count of yarn could be spun with finer wool top.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. Method of spinning all wool yarn on a cotton system, the system having front, back, second and third pairs of rollers, comprising cutting and drafting wool top between the front and the third pairs of rollers while removing the second and the back top rollers, or between the front and the back pairs of rollers while removing the second and the back pairs of rollers on a cotton drawing frame with a predetermined distance between the drafting rollers at first passage of drawing, proceeding to second passage of drawing with same drafting mechanism of the first passage and proceeding to additional passages until a last passage of drawing process is done, forming wool roving on a cotton roving frame by drafting fed wool sliver from the last passage of the drawing process, using three pairs of rollers and one pair of aprons with a distance set equivalent to the first passage of drawing process between the front and back rollers of the roving frame, engraving or cutting the top rollers of the middle roller pair, and spinning wool yarn on a cotton ring frame by drafting roving using three pairs of rollers and one pair of the aprons with a distance set equivalent to the first passage of the drawing frame between the front and back rollers of the ring frame, engraving or cutting the top roller of the middle roller pair.

2. Method of spinning all wool yarn on the cotton system, according to claim 1, further comprising setting the distance between the front and third rollers or between the front and back pairs of the rollers, at 55 to 160 mm on each frame of drawing, roving, and the ring spinning.

3. Method of spinning all wool yarn on the cotton system, according to claim 2, further comprising setting and controlling the distance between the front and the third rollers or between the front and back pairs of rollers, at lengths of 55 mm, 120 mm, and 160 mm.

4. Method of spinning all wool yarn on the cotton system according to claim 1, further comprising engraving the middle roller of roving and ring frame as a groove.

* * * * *